US005704418A

United States Patent [19]

Baader et al.

[11] Patent Number: 5,704,418

[45] Date of Patent: Jan. 6, 1998

[54] HEAT TRANSFER DEVICE

[75] Inventors: Alexander Baader, Stuttgart; Markus Weyrich, Weil der Stadt, both of Germany

[73] Assignee: Behr GmbH & Co., Stuttgart, Germany

[21] Appl. No.: 663,409

[22] Filed: Jun. 13, 1996

[30] Foreign Application Priority Data

Jul. 19, 1995 [DE] Germany ..... 195 26 286.7

[51] Int. Cl.[6] ..... F01P 11/10

[52] U.S. Cl. ..... 165/121; 165/DIG. 311; 165/68.1

[58] Field of Search ..... 165/41, 121, 122, 165/DIG. 311; 123/41, 49; 180/68.1, 68.4

[56] References Cited

U.S. PATENT DOCUMENTS 4,955,434 9/1990 Price ..... 165/122
5,024,267 6/1991 Yamaguchi et al. ..... 165/122
5,474,121 12/1995 Bryson et al. ..... 165/41
5,522,457 6/1996 Lenz ..... 165/121
5,626,202 5/1997 Barnes et al. ..... 180/68.1

FOREIGN PATENT DOCUMENTS 0 219 021 4/1987 European Pat. Off. .

*Primary Examiner*—Allen J. Flanigan
*Attorney, Agent, or Firm*—Evenson McKeown Edwards & Lenahan PLLC

[57] ABSTRACT

Heat transfer devices, particularly the radiators for internal-combustion engines of motor vehicles are provided with a fan shroud and a fan arrangement. In this case, the shroud must be adapted to the dimensions of the radiator in such a manner that it can be fastened on the coolant tanks. The fastening of the fan shroud is carried out at least partially on the bent outer edges of the fins of the finned tube block, such that differently dimensioned fan shrouds can be connected to different finned block locations.

12 Claims, 2 Drawing Sheets

HEAT TRANSFER DEVICE

BACKGROUND AND SUMMARY OF THE INVENTION

This invention relates to a heat transfer device, particularly a radiator for an internal-combustion engine of a motor vehicle, which includes a finned tube block constructed of a plurality of tubes held in parallel to one another in two tube bottoms each covered by one coolant tank respectively and of fins extending transversely to these tubes and arranged at a distance from one another. The finned tube block is provided on its sides extending perpendicularly with respect to the tube bottoms with at least one fastening strip which consists of two L-shaped strip parts which can be connected with one another in a locking manner to form a U-profile and are clamped against the ends of the fins, which are bent by approximately 90°, by means of comb-type projections.

Heat transfer devices of this type are known from European Patent Document EP 0 401 590 B1. There, lateral parts are assigned in this manner to the finned tube block, which lateral parts are held on the fins which are equipped with fastening legs and with breakthroughs for the fastening of the radiator. In this case, the lateral parts form U-profiles whose legs point toward the outside.

Heat transfer devices are also known (European Patent Document EP 0 219 021 B1) which are equipped with a fan shroud which is disposed frontally in front of the finned tube block. This fan shroud is connected with the upper and the lower radiator tank by means of detent hooks. In the case of this construction, the two radiator tanks are connected to form a frame by way of lateral parts.

The arrangement of a fan shroud in front of the finned tube block requires that this fan shroud, even if it is connected in an also known manner by way of studs with the radiator tanks, is adapted to the dimensions of the radiator tanks and of the finned tube block. This requires that, for heat transfer devices of different capacities and therefore also of differently dimensioned finned tube blocks, different types of fan shrouds must be available whose manufacturing requires different tools and therefore also relatively high expenditures.

It is an object of the invention to develop heat transfer devices with fan shrouds assigned to the finned tube block such that the adaptation of the fan shroud to different dimensions of the finned tube block is not necessary.

For achieving this object, it is provided according to the present invention in the case of a heat transfer device of the initially mentioned type that the fastening strip is part of a fan shroud, that the fastening strip frames the finned tube block by means of inwardly directed legs and is held on its fins for the fastening of the fan shroud. In this case, the invention is based on the consideration that the fastening of lateral parts provided in the case of heat transfer devices of the initially mentioned type, if it is correspondingly modified, can also be utilized in a very advantageous manner for the fastening of a fan shroud which then becomes independent of the position of the coolant tanks and can be assigned directly to the finned tube block. This also opens up the possibility of assigning the fan shroud only to a portion of the surface of the finned tube block because it was found in many applications that the flow through the radiator provided for the internal-combustion engine which is necessarily caused by a fan and is independent of the air stream must not necessarily take place along the whole surface of the finned tube block.

As a further development of the invention, it is particularly expedient to fasten the fan shroud on one side on one of the coolant tanks and to fasten it only on the other side on the finned tube block. This embodiment makes it possible, for example, for cross-flow radiators whose increase of output is achieved by a larger width and thus by a longer tube arrangement, to provide only one type of fan shroud which covers only a certain tube length and then, according to the width of the radiator, leaves a more or less large portion of the finned tube block exposed. However, as a result of this embodiment, a series of radiators of different outputs can be complemented with a single type of fan shroud which contributes to a significant simplification of the manufacturing. In a further embodiment of the invention, the fastening points for the fastening on the coolant tank may be mounted on clips which project laterally beyond the fan shroud and which may advantageously be provided with reinforcing ribs which extend in the direction of the axes of the tubes of the finned tube block to a frame which frames the fan blades. As a result of this measure, a very stable fastening of the fan shroud is achieved by way of the assignment to a radiator tank. The fastening on the fins completes this one-sided fastening.

Finally, in embodiments also contemplated by the invention, in a simple manner and in order to achieve a saving of material that is as large as possible for the manufacturing of the fan shroud, to let the frame, on the side facing away from the fastening points on the coolant tank, be tangent with respect to an outer shroud bounding edge from which the two fastening strips surrounding the finned tube block extend in the direction of the coolant tank. In this case, these fastening strips may have a length which is smaller than the radius of the fan frame. These embodiments can be manufactured with a minimum of material expenditures.

Other objects, advantages and novel features of the present invention will become apparent from the following detailed description of the invention when considered in conjunction with the accompanying drawings.

DETAILED DESCRIPTION OF THE DRAWINGS

Figures 1, 2:
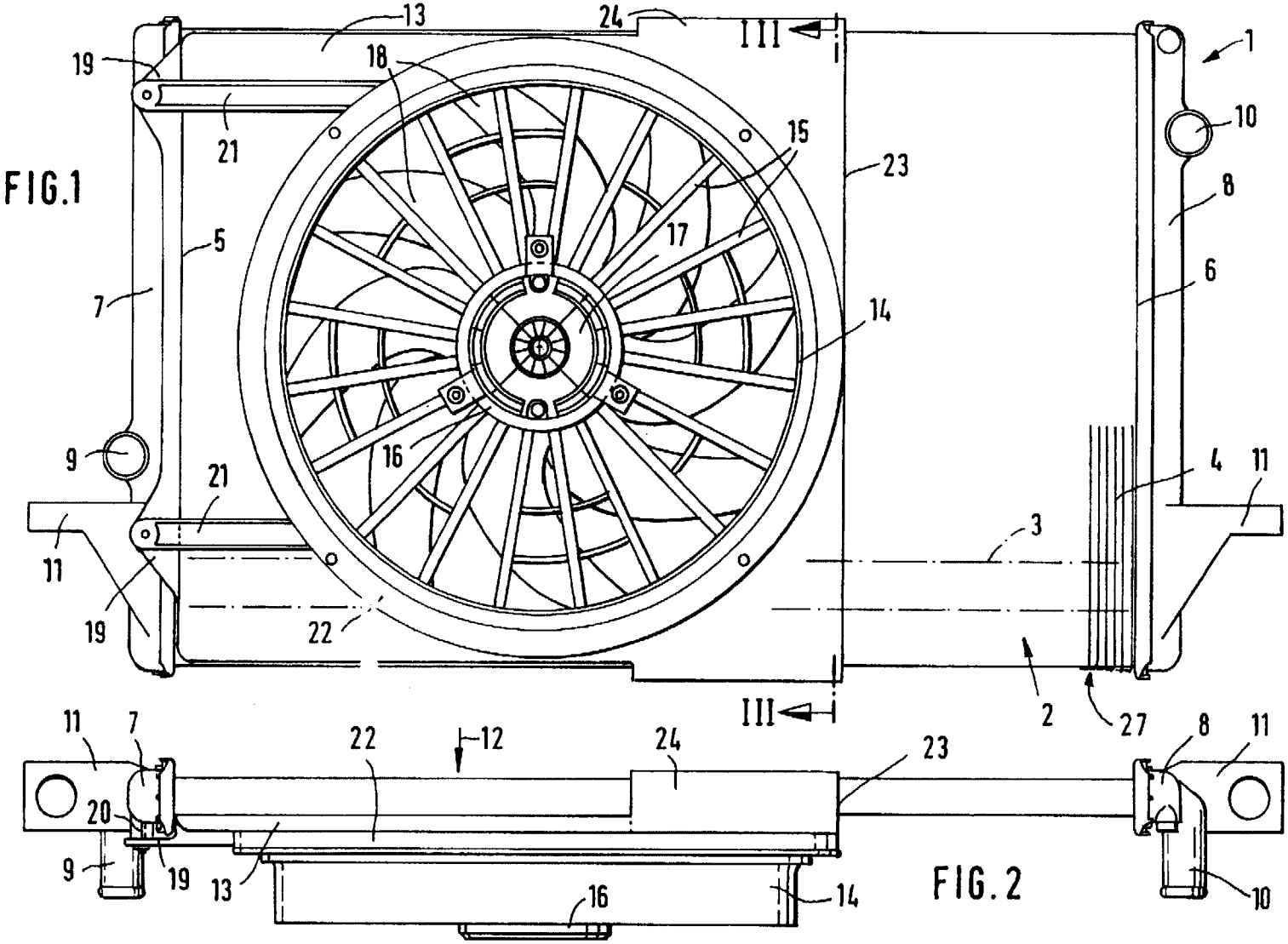
FIG. 1 is a schematic frontal view of a heat transfer device constructed as a cross-flow radiator with a fan shroud fastened according to a preferred embodiment of the invention.
FIG. 2 is a top view of the heat transfer device of FIG. 1.
Figure 3:
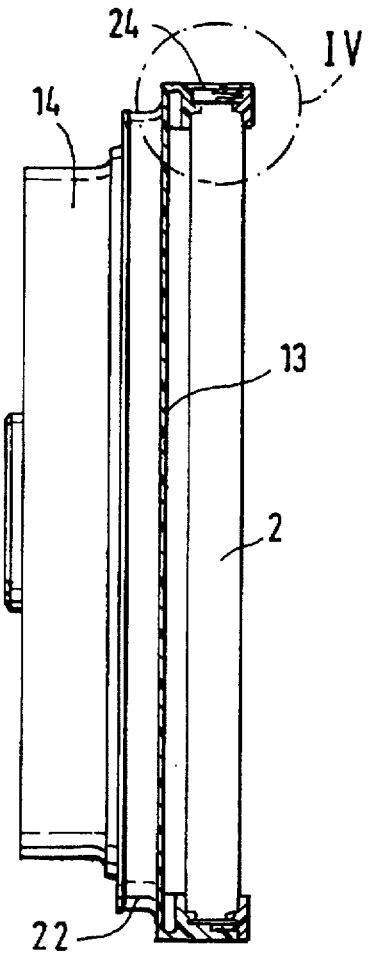
FIG. 3 is a schematic sectional representation along the intersection line III—III in FIG. 1.

FIGS. 1 to 3 illustrate a heat transfer device 1 which is designed as a cross-flow radiator and is used for cooling the coolant of an internal-combustion engine of a motor vehicle which is not shown. The heat transfer device 1 consists of a finned tube block 2 which, in a manner not shown in detail, consists of several tubes which extend in the direction of the axes 3 but are not shown and of fins 4 which extend perpendicularly thereto and in parallel, in each case, to the tube bottoms 5 and 6 in which the ends of the tubes extending in the direction of the axes 3 are held in a sealed manner. The tube bottoms 5 and 6 are each covered by a coolant tank 7 and 8 which, in each case, in a known manner, is tightly connected with the tube bottoms 5 and 6. Coolant can therefore be fed to the coolant tank 8 by way of a feeding opening 10, then flows through the tubes extending in the direction of the axes 3, and leaves the coolant tank 7 through the connection piece 9. The two coolant tanks 7 and 8 are each connected with a fitted-on clip 11 by means of which a fastening of the cross-flow radiator 1 takes place in the vehicle. The coolant tanks 7 and 8 may consist of a plastic material.

A fan shroud 13 is connected behind the finned tube block 2 in the flow direction 12 of the air used for the cooling of the coolant and consists of a frame 14 arranged in a covering and of a hub 16 held inside this frame by way of spokes, a driving motor 17 for a fan being disposed in the hub 16 and the blades 18 of the fan rotating inside the frame 14.

On its end facing the coolant tank 7, the fan shroud 13 is provided with two clips 19 which reach over the coolant tank on the downstream side, rest on lateral projections 20 of the coolant tank 7 and are connected with these projections 20 by way of screws. Reinforcing ribs 21 extend from the clips 19 to a frame 22 surrounding the fan frame 14. On the side facing away from the clips 19, the covering of the fan shroud 13 merges into an outer edge 23 extending in parallel to the fins 4, and from this outer edge 23, two fastening strip pieces 24 extend to the interior of the fan shroud 13. The length of the fastening strips 24 viewed in the direction of the axes 3 of the tubes, in this case, is smaller than the radius of the frame 22 surrounding the fan arrangement.

Figure 4:
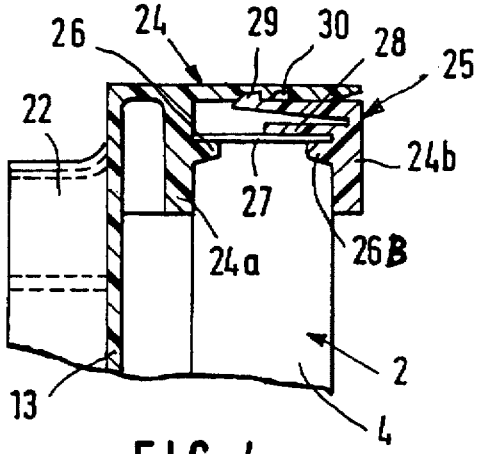
FIG. 4 is an enlarged representation of the detail IV in FIG. 3 which shows the type of locking of the parts of the fastening strip.

FIGS. 3 and 4 illustrate that these fastening strips 24 consist of two leg parts **24*a* and 24*b*, the leg 24*a* being fixedly connected with the fan shroud 13 and the leg 24*b* being part of a comb-type strip piece 25 which is slid by means of comb-type projections 26 between adjacent fins whose ends 27, bent by 90°, are received in a groove between the comb-type projections 26 and a contact strip 28 and are held in a locking manner by means of a detent clip 29 in an indentation 30 of the exterior part of the fastening strip 24**.

The fixed part of the fastening strip 24 also has comb-type projections 26 in the area above a leg part 24a which correspond to the comb-type projections 26B of the second strip part 25. The bent outer edges 27 of the fins 4 are therefore surrounded on both sides and held by the parts of the fastening strip 24 and in this manner the fan shroud 13 can be secured on the finned tube block on the side facing away from the coolant tank 7. In this case, the fastening of the bent ends 27 of the individual fins 4 takes place, however, in the manner known from European Patent Document EP 0 401 590 B1 for the arrangement of a lateral part with legs pointing toward the outside, thus away from the finned tube block. In this respect, this European Patent Document EP 0 401 590 B1 is therefore also made the object of the disclosure of the present application.

As clearly shown in FIG. 1, the fan shroud 13 does not extend over the whole face of the finned tube block 2. The portion of the finned tube block situated on the right of the edge 23 remains uncovered by the fan shroud 13. This construction therefore has the advantage that the fan shroud 13 would also fit on a cross-flow radiator which is much wider than the illustrated radiator 1 and whose area not covered by the fan shroud 13 would therefore extend still farther to the right. As a result of the new construction, the same type of fan shroud can therefore be combined with different radiators without the requirement of a respective adaptation to the radiator dimensions.

It is also contemplated by the invention to fasten the fan shroud exclusively by means of fastening strips, like fastening strip 24, on the finned tube block and to do without a fastening on the coolant tank. Another pair of fastening strips 24 would then have to be assigned to the fan shroud 13 on the side situated on the left in FIG. 1. It is also not absolutely necessary to let the fan shroud 13 end with an outer edge 23 which is tangent with respect to the frame 22. Rather, embodiments are contemplated by the invention wherein the outer edge 23 is displaced more toward the right so that the fan frame 14 is situated approximately in the center of the width of the fan shroud. It is decisive that one and the same type of fan shroud, as a result of the type of fastening on the finned tube block, can be used for different widths of radiators so that a different fan shroud must not be assigned to every type of radiator.

Finally, embodiments are also contemplated wherein shroud 13 in the area situated outside the frame 22 is divided in parallel to the course of the tube axes 3 and is constructed of parts which can be displaced with respect to one another in a telescope-type manner but can be locked with one another, so that also an adaptation of the fan shroud fastening to the height of the radiator is possible when this is desired. It is a prerequisite in all cases that the fastening takes place at least partially in the described manner on the fins 4 of the finned tube block 2.

Figure 5:
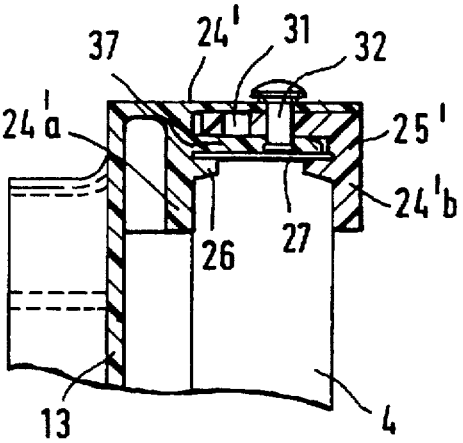
FIG. 5 is a representation similar to FIG. 4, however, in the case of a different type of joining of the fastening strip.
Figure 6:
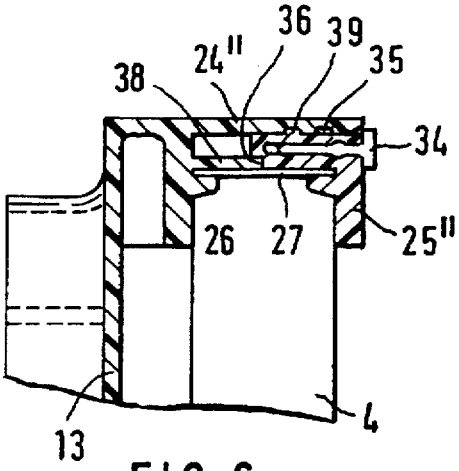
FIG. 6 is a view of another embodiment of the fastening strip.
Figure 7:
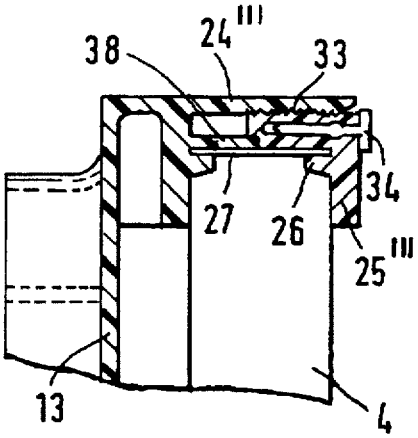
FIG. 7 finally is a view of another variant of the embodiment according to FIG. 6.

FIGS. 5 to 7 show other possibilities of assembling the two parts of the strip 24 for the purpose of locking the bent ends 27 of the fins 4. Thus, FIG. 5, for example, shows the possibility of providing the comb-type strip part 25' with a slide-in clip with openings 31 and then fixedly connecting this slide-in clip by means of a rivet 32 with an outward-projecting leg part 37 of the fastening strip 24'. In this case, the clip of the strip part 25' provided with the openings 31 is slid into a groove between the parts 24' and 37 in order to lock the bent ends 27.

FIG. 6 shows a modification in that here the leg 37 of the embodiment of FIG. 5 remained as a short leg piece 38 whose outer edge 36 is used as a stop for the comb-type partial strip 25" which can now be slid directly onto the outer side of the bent edges 27. This strip 25" is provided with a leg part which can be slid in and which has a gap into which a clamping strip 34 can be slid from the outside when the end position according to the representation in FIG. 6 is reached. A projection 39 of the strip 25" locked in the opening 35 will then be secured in this detent position.

FIG. 7 illustrates a variant which has a construction very similar to the embodiment of FIG. 6, with the exception that the individual locking openings or grooves 35 are replaced by a fine embossing 33 by means of which it is possible to very finely adapt the slid-in position of the partial strip 25'" before the securing strip 34 is slid in.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A radiator for an internal combustion engine driven motor vehicle, comprising:

a finned tube block formed of a plurality of parallely extending tubes and a plurality of fins extending transversely of the tubes, at least some of said fins including bent over ends, a fan shroud, and a fastening strip connecting the fan shroud to the finned tube block, said fastening strip including two interlocking engageable L-shaped strip parts which form a U-profile clamped against said bent over ends of said fins, one of said L-shaped strip parts forming part of the fan shroud.

2. A radiator according to claim 1, wherein said two L-shaped strip parts are interlockingly engageable by way of respective comb-type projection of said L-shaped strip parts.

3. A radiator according to claim 1, comprising a pair of tube bottoms supporting respective opposite ends of said tubes, and a pair of coolant tanks covering respective ones of said tube bottoms.

4. A radiator according to claim 3, wherein said two L-shaped strip parts are interlockingly engageable by way of respective comb-type projection of said L-shaped strip parts.

5. A radiator according to claim 3, wherein one side of the fan shroud is fastened on one of the coolant tanks and on another side of the fan shroud is fastened on the finned tube block by the fastening strip.

6. A radiator according to claim 5, wherein the fastening points for the fastening on the coolant tank are mounted on clips which laterally project beyond the fan shroud.

7. A radiator according to claim 6, wherein the clips are provided with reinforcing ribs which extend in a direction of axes of the tubes of the finned tube block to a frame of the fan shroud framing fan blades.

8. A radiator according to claim 7, wherein on the side facing away from the fastening points on the coolant tank, the frame is tangent with respect to an outer shroud bounding edge from which the two fastening strips surrounding the finned tube block extend in the direction of the coolant tank.

9. A radiator according to claim 8, wherein the fastening strips have a length which is smaller than the radius of the frame.

10. A radiator according to claim 3, wherein the fan shroud is divided in parallel to axes of the tubes of the finned tube block and comprises segments which can be slid with respect to one another in a telescope-typed manner.

11. A method of making a radiator for an internal combustion engine driven motor vehicle, comprising:

forming a finned tube block with a plurality of parallely extending tubes and a plurality of fins extending transversely of the tubes, bending ends of at least some of said fins to form bent over ends of said fins, providing a fan shroud including an L-shaped strip part, and fastening the fan shroud to the finned tube block by interlockingly engaging the L-shaped strip part of the fan shroud with another L-shaped strip part to form a U-profile clamped against the bent over ends of said fins.

12. A method according to claim 11, wherein said interlockingly engaging includes connecting comb-like projections of said L-shaped strip parts.

* * * * *